US010549337B2

(12) United States Patent
Yuan

(10) Patent No.: US 10,549,337 B2
(45) Date of Patent: Feb. 4, 2020

(54) GECKO GUN

(71) Applicant: Yuyao Tangwen Tool Co., Ltd., Yuyao (CN)

(72) Inventor: Jianming Yuan, Yuyao (CN)

( * ) Notice: Subject to any disclaimer, the term of this patent is extended or adjusted under 35 U.S.C. 154(b) by 317 days.

(21) Appl. No.: 15/261,875

(22) Filed: Sep. 10, 2016

(65) Prior Publication Data

US 2018/0050384 A1 Feb. 22, 2018

(30) Foreign Application Priority Data

Aug. 17, 2016 (CN) ..... 2016 1 0701183

(51) Int. Cl.
*B23P 19/04* (2006.01)
*B21J 15/38* (2006.01)

(52) U.S. Cl.
CPC ..... *B21J 15/383* (2013.01)

(58) Field of Classification Search
USPC ..... 29/243.53, 243.521, 751; 81/310, 313, 81/349, 373
See application file for complete search history.

(56) References Cited

U.S. PATENT DOCUMENTS 3,212,317 A * 10/1965 Lynch, Jr. ..... H01R 43/042 72/413
4,561,282 A * 12/1985 Hadden, Sr. ..... B25B 7/123 29/751
8,863,392 B2 * 10/2014 Lin ..... A01G 2/30 30/131

* cited by examiner

*Primary Examiner* — Joseph J Hail
*Assistant Examiner* — Shantese L McDonald
(74) *Attorney, Agent, or Firm* — W&K IP

(57) ABSTRACT

The present invention discloses a gecko gun, which includes a housing with a left handle on the bottom, and a right handle. The mentioned left handle and right handle are all covered by a handle housing. The mentioned cover housing is installed with a U-shaped seat at the top end. The top end of the right handle is rotated with the top end of the housing through a spindle. The top end of the right handle is installed with a link mechanism, which is covered by the mentioned housing and fixed to the housing via screws. The link mechanism includes a first linkage assembly linked to the top end of the right handle and a second linkage assembly connected to the first linkage assembly, and the second linkage assembly is used to drive the U-shaped seat to shift forward and backward. Thereby the designed gecko gun will help achieve the effect of energy saving.

10 Claims, 6 Drawing Sheets

GECKO GUN

CROSS-REFERENCE TO RELATED APPLICATIONS

This application claims priority benefit of Chinese Patent Application No. 201610701183.9 with a filing date of Aug. 17, 2016. The content of the aforementioned application, including any intervening amendments thereto, are incorporated herein by reference.

TECHNICAL FIELD

The present invention relates to the technical field of riveting tools, specifically a gecko gun.

BACKGROUND OF THE PRESENT INVENTION

Gecko gun is a tool for riveting nuts, which can rivet nuts on the plate and is of a wide use. The existing gecko gun is usually structured with a housing, a left handle at the end of the housing, a right handle, a right connecting rod at the top end of the right handle, a chute on the connecting rod, a slide pin in the chute, a U-shaped seat mounted on the top end of the housing, a recess on the outer wall of U-shaped seat to lock the gecko peg. The core of the gecko peg will be locked to the U-shaped seat and the part comes out the housing will be locked to the place that needs to be riveted. Hold the right handle and the left handle to make them close up, then the connecting rod and the U-shaped seat will be pulled backward, and the U-shaped seat will drive the core of the gecko peg to move backward, thus making the gecko peg be fixed.

The gecko gun supported by technology mentioned above may help achieve the riveting of gecko pegs, but the following problems still exist in the course of use: due to the unreasonable design of the arm of force of the gecko gun, it will take great effort for people to open or close the handles, and for people who are not strong, they even need to use the gun with both hands. Therefore, this kind of gecko gun is time-consuming and energy-consuming, and it needs to be further improved.

SUMMARY OF PRESENT INVENTION

In view of the deficiencies of the existing gecko gun, present invention is aimed to provide an effortless gecko gun.

Technical solution of the present invention is as follows: the gecko gun includes a housing with a left handle on the bottom, and a right handle. The mentioned left handle and right handle are all covered by a handle housing. The mentioned cover housing is installed with a U-shaped seat at the top end. The top end of the right handle is rotated with the top end of the housing through a spindle. The top end of the right handle is installed with a link mechanism, which is covered by the mentioned housing and fixed to the housing via screws. The link mechanism includes a first linkage assembly linked to the top end of the right handle and a second linkage assembly connected to the first linkage assembly, and the second linkage assembly is used to drive the U-shaped seat to shift forward and backward.

Furthermore, the mentioned first link assembly comprise paralleled first link rods with the same shape and size. One end of the first link rods is fixed to the top end of the right handle. The mentioned second link assembly comprises two second link rods which are fixed to the top end of the right handle by one end and below the first link rods, and a connecting rod, assembly installed on one end of the second link rods to drive the U-shaped seat to shift forward and backward.

The mentioned two first link rods are installed with a first pin on one end, and a long chute on the other end. The top end of the right handle is provided with a first pin hole for the first pin to be inserted by upper and lower ends. The mentioned two second link rods are installed with a second pin on one end, and a short chute on the other end. The top end of the right handle is provided with a second pin hole for the second pin to be inserted by upper and lower ends. The connecting rod assembly comprises two connecting rods, and the first concave boss and second concave boss fixed to two ends of the connecting rods. The mentioned first concave boss will go through the long chute and slide with the long chute. The mentioned second concave boss will go through the short chute and slide with the short chute. The connecting rod is provided with a positioning axis, the top and bottom ends of which are fixed to the top end of the housing.

The distance between the mentioned positioning axis and the first concave boss shall be longer than the distance between the positioning axis and the second concave boss.

The mentioned U-shaped seat is provided with a punching hole on the inner end, and the upper and lower ends of the first concave boss shall be fixed via the punching hole. The U-shaped seat is provided with a positioning slot on the other end.

The mentioned housing is provided with a neck on one side of the top end corresponding to the positioning slot.

The top end of the right handle is further provided with a third pin hole, and the mentioned first pin hole, third pin hole and second pin hole are set from top to bottom. The mentioned spindle is set through the third pin hole. The top end of the housing is provided with a positioning hole for the upper and lower ends of the spindle to be locked into. The spindle is covered by, a torsion spring. The torsion spring has two bifurcations, wherein one of the bifurcation abuts against the second pin and its lower end locks into the left handle; the other bifurcation abuts the connecting rod, and its lower end locks into the right handle.

The distance between the mentioned first pin hole and the third pin hole is shorter than the distance between the second pin hole and third pin hole.

The top end of the left handle is provided with a hook, and one end of the hook locks on the outer wall of the right handle.

The mentioned housing is provided with a long cover plate and short cover plate on two sides of the top end. The long cover plate has a cylinder with threaded hole. The housing is provided with a through hole on the top end for the cylinder to go through. The cylinder goes through the through hole and then will be fixed to the short cover plate by a fastening screw.

For the presented gecko gun, when the right handle is folded, the first linkage assembly will give a backward force to the U-shaped seat; and then when the U-shaped seat goes forward, the second linkage assembly will also give U-shaped seat a backward force. The same principle follows when the right handle is opened, with a difference only in the direction of the force. Therefore, the two forces will help to save the energy, so as to make the right handle easily be opened or folded.

PARTS SHOWN IN THE FIGURES

Figure 1:
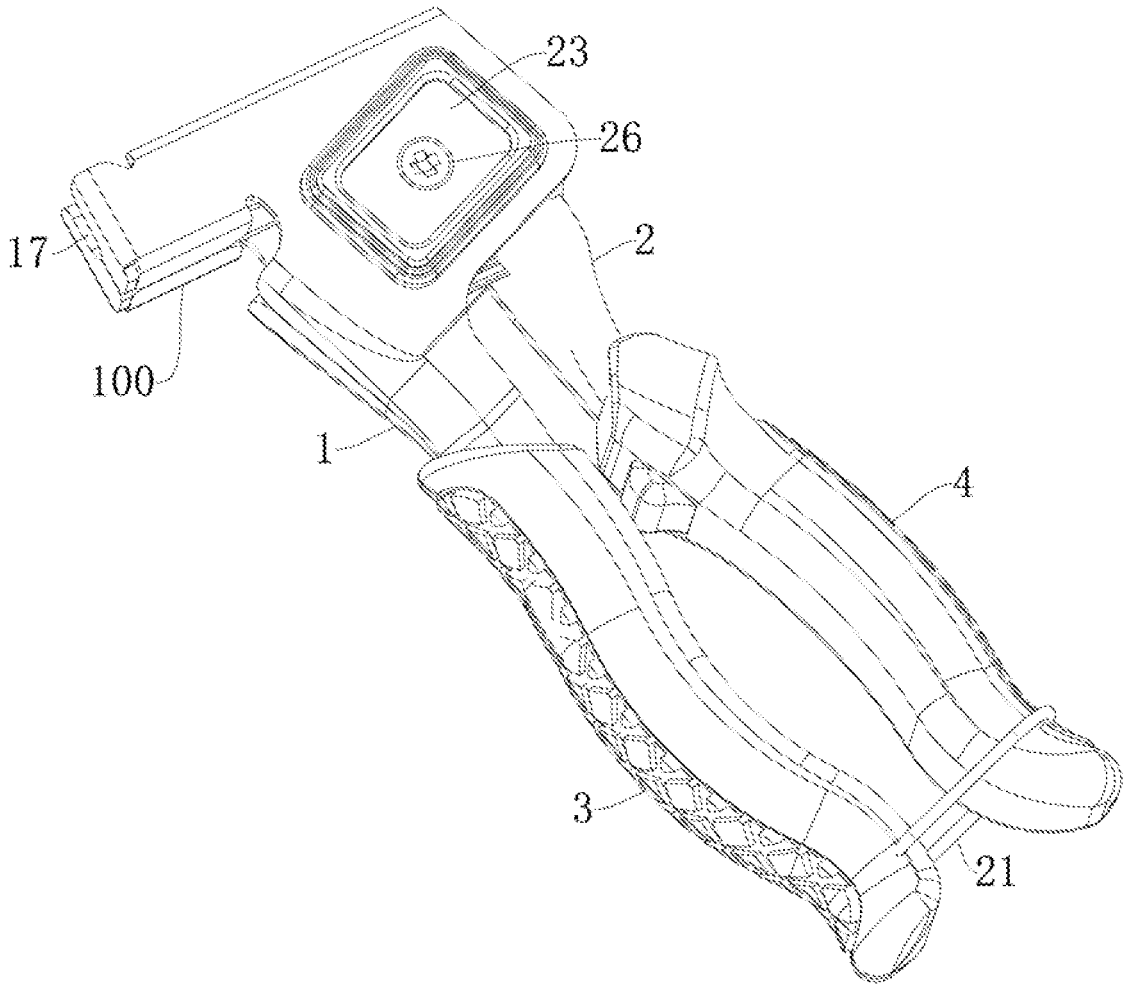
FIG. 1 is the overall structure diagram of the present invention.
Figure 2:
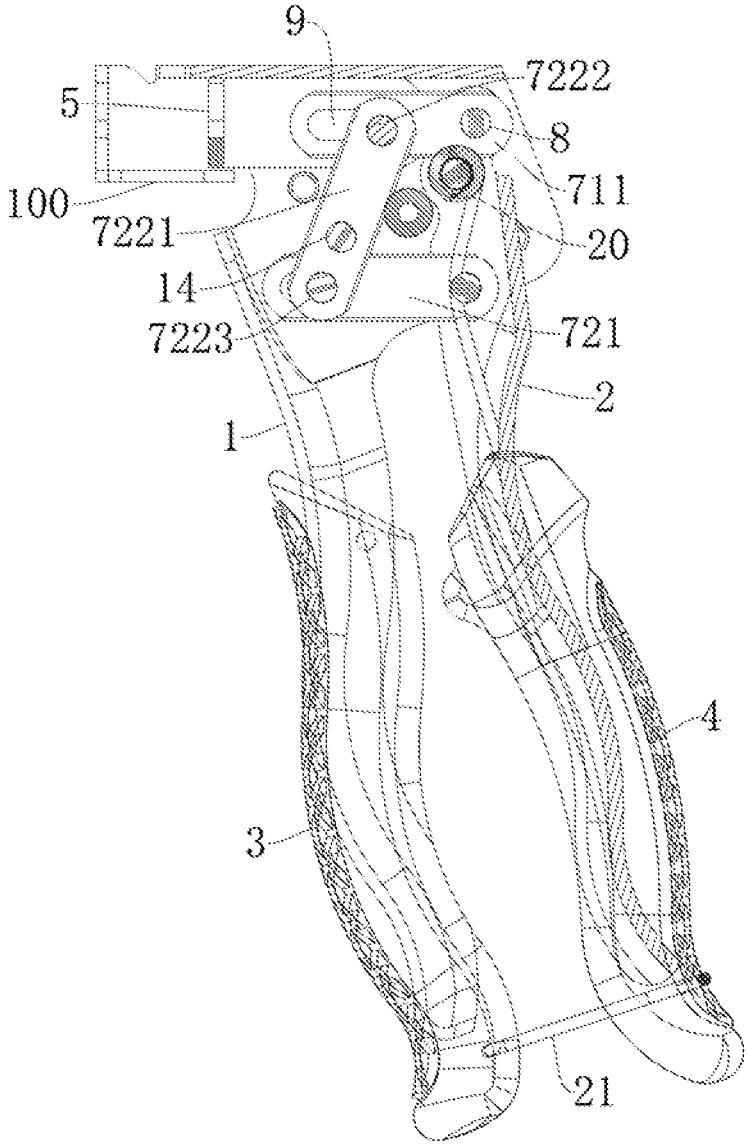
FIG. 2 is a cross-sectional schematic diagram of the present invention.
Figure 3:
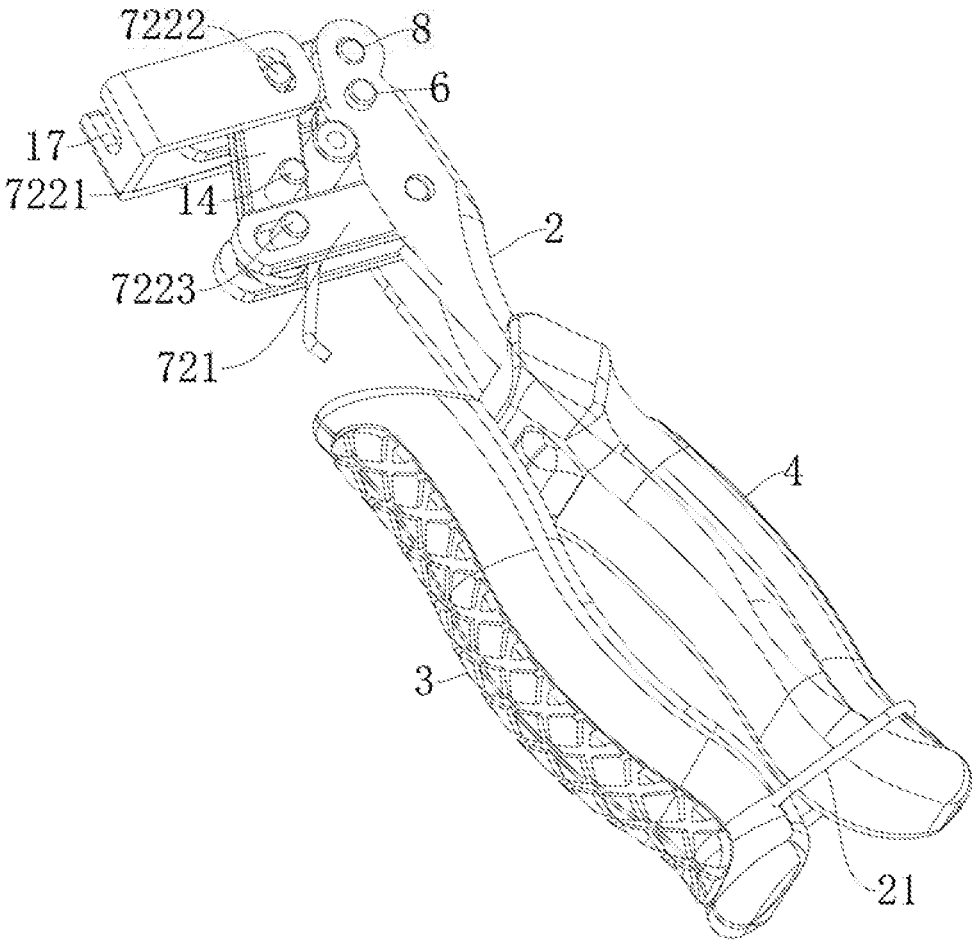
FIG. 3 is the schematic diagram of the present invention when the housing, long cover plate and short cover plate are removed.
Figure 4:
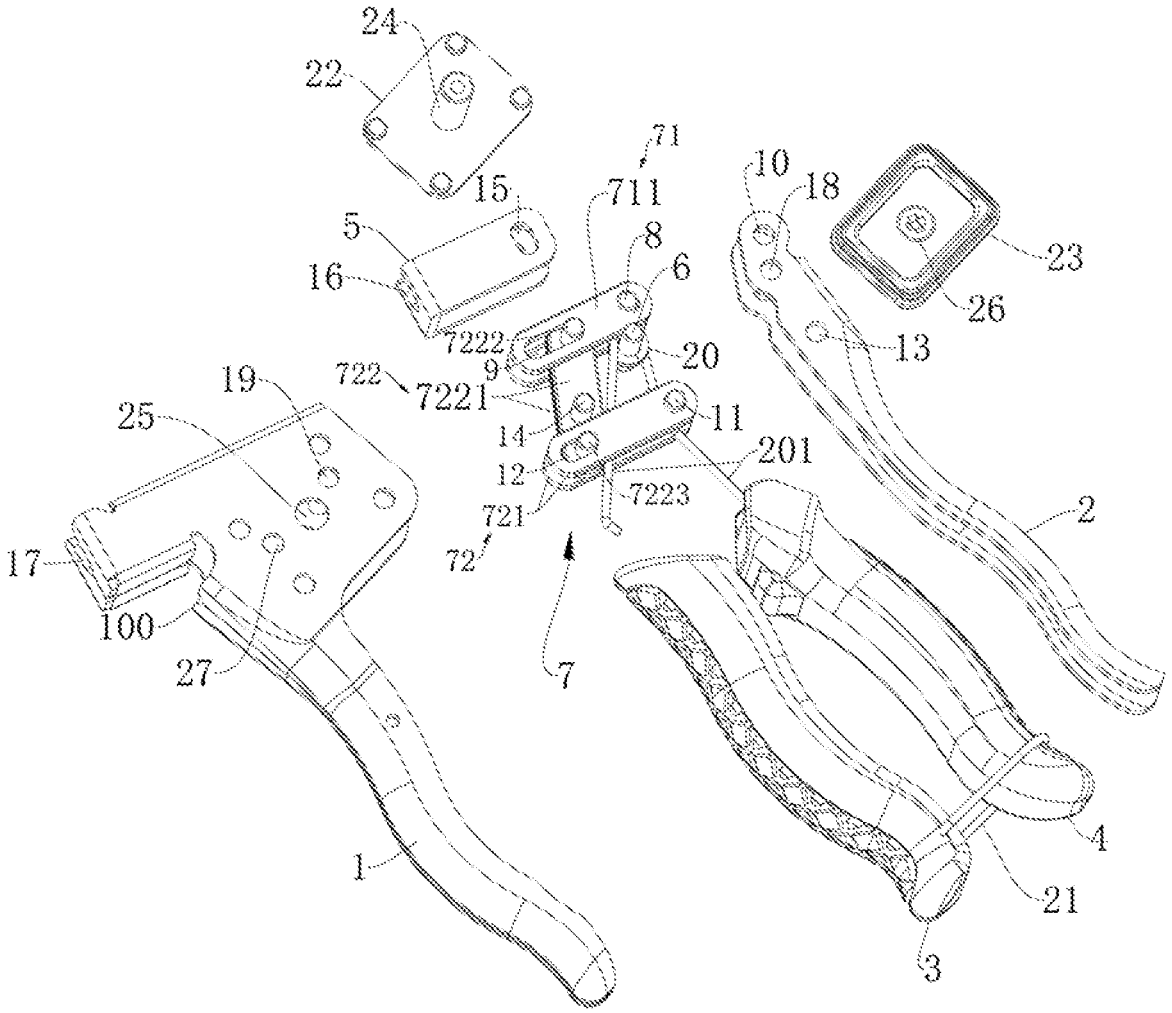
FIG. 4 is an exploded schematic view of the invention.

100—housing; 1—left handle; 2—right handle, 3—left handle housing; 4—right handle housing; 5—U-shaped seat; 6—spindle; 7—link mechanism; 71—first linkage assembly; 711—first link rod; 72—second linkage assembly; 721—second link rod; 722—connecting rod assembly; 7221—connecting rod, 7222—first concave boss; 7223—second concave boss; 8—first pin; 9—long chute; 10—first pin hole; 11—second pin; 12—short chute; 13—second pin hole; 14—positioning axis; 15—punching hole; 16—positioning slot; 17—locking slot; 18—third pin hole; 19—positioning hole; 20—torsion spring; 201—bifurcation; 21—hook; 22—long cover plate, 23—short cover plate; 24—cylinder; 25—through hole; 26—fastening screws; 27—fixing hole.

DETAILED DESCRIPTION OF PREFERRED EMBODIMENTS

In order to make people have a direct and complete understanding of the technology scheme of the present invention, here the following unlimited instructions are given combined with the appended figures.

As shown from FIG. 1 to FIG. 6, the gecko gun includes a housing 100 with a left handle 1 on the bottom and a right handle 2. The left handle 1 and right handle 2 are all covered by a handle housing 3 and 4. The housing 100 is installed with a U-shaped seat 5 at the top end. The top end of the right handle 2 is rotated with the top, end of the housing 100 through a spindle 6. The top end of the right handle 2 is installed with a link mechanism 7, which is covered by the housing 100 and fixed to the housing 100 via screws. The link mechanism 7 includes a first linkage assembly 71 linked to the top end of the right handle 2 and a second linkage assembly 72 connected to the first linkage assembly 71, and the second linkage assembly 72 is used to drive the U-shaped seat 5 to shift forward and backward.

The first link assembly 71 comprises two paralleled first link rods 711 with the same shape and size. One end of the first link rod 711 is fixed to the top end of the right handle 2. The second link assembly 72 comprises two second link rods 721 which are fixed to the top end of the right handle 2 by one end and below the first link rods 711 and a connecting rod assembly 722 installed on one end of the second links 721 to drive the U-shaped seat 5 to shift forward and backward. The two first link rods 711 are installed with a first pin 8 on one end, and a long chute 9 on the other end. The top end of the right handle 2 is provided with a first pin hole 10 for the first pin 8 to be inserted by upper and lower ends. The two second link rods 721 are installed with a second pin 11 on one end, and a short chute 12 on the other end. The top end of the right handle 2 is provided with a second pin hole 13 for the second pin 11 to be inserted by upper and lower ends. The connecting rod assembly 722 comprises two connecting rods 7221, and the first concave boss 7222 and second concave boss 7223 fixed to two ends of the connecting rod 7221. The mentioned first concave boss 7222 will go through the long chute 9 and slide with the long chute 9. The second concave boss 7223 will go through the short chute 12 and slide with the short chute 12. The connecting rod 7221 is, provided with a positioning axis 14, the top and bottom ends of which 14 are fixed to the top end of the housing 100. On the top end of the housing 100, there is a fixing hole 27 for the fixation of the positioning axis 14.

The distance between the positioning axis 14 and the first concave boss 7222 is longer than the distance between the positioning axis 14 and the second concave boss 7223. When the connecting rod moves, since the position of the positioning axis 14 and the housing 100 will not change when fixed, there will be an arm of force between the positioning axis 14 and the first concave boss 7222, while another arm of force will also be formed between the positioning axis 14 and the second concave boss 7223. Since the short chute 12 is much shorter than the long chute, the distance between the positioning axis 14 and the first concave boss 7222 is two times longer than the distance between the positioning axis 14 and the second concave boss 7223.

In order to facilitate the connection between the U-shaped seat 5 and the first concave boss 7222, a punching hole is installed on the inner side of the U-shaped seat 5. The upper and lower ends of first concave boss 7222 are fixed in the punching hole 15, and a positioning slot 16 is provided on the other end of the U-shaped base 5. The housing 100 is provided with a neck 17 on one side of the top end corresponding to the positioning slot 16. When installing the gecko peg, lock the inner end of the peg in the neck 17, and the core of the peg will be locked in the positioning slot 16. When riveting gecko peg, pull the core of the peg through the U-shaped seat 5, so as to rivet the peg exposed outside of the housing 100.

The top end of the right handle 2 is further provided with a third pin hole 18, and the first pin hole 10, third pin hole 18 and second pin hole 13 are set from top to bottom. The spindle 6 is set through the third pin hole 18. The top end of the housing 100 is provided with a positioning hole 19 for the upper and lower ends of the spindle 6 to be locked into. The spindle 6 is covered by a torsion spring 20. The torsion spring 20 has two bifurcations 201, wherein one of the bifurcation 201 abuts against the second pin 11 and its 201 lower end locks into the left handle 1; the other bifurcation 201 abuts the connecting rod 7221, and its 201 lower end locks into the right handle 2. The distance between the first pin hole 10 and the third pin hole 18 is shorter than the distance between the second pin hole 13 and the third pin hole 18, so there will be an arm of force formed between the first pin 8 and the spindle 6 and an arm of force formed between the second pin and spindle 6. In order to make it most energy-saving when pulling or pressing right handle 2, the distance between the second pin 11 and the spindle 6 shall be two times longer than that between the first pin 8 and the spindle 6 at least.

The top end of the left handle housing 3 is provided with a hook 21, and one end of the hook 21 locks on the outer wall of the right handle 2. The set of the torsion spring 20 will facilitate the opening of right handle 2. In order to close up two handles, right handle 2 and left handle 1, people can only cover the outer wall of the right handle 2 with the hook 21.

In order to achieve a stable fixation of the housing 100 and the connecting rod assembly, housing 100 is provided with a long cover plate 22 and short cover plate 23 on two sides of the top end. The long cover plate 22 has a cylinder 24 with threaded hole. The housing 100 is provided with a through hole 25 on the top end for the cylinder 24 to go through. The cylinder 24 goes through the through hole 25 and then will be fixed to the short cover plate 23 by a fastening screw (26).

Figure 5:
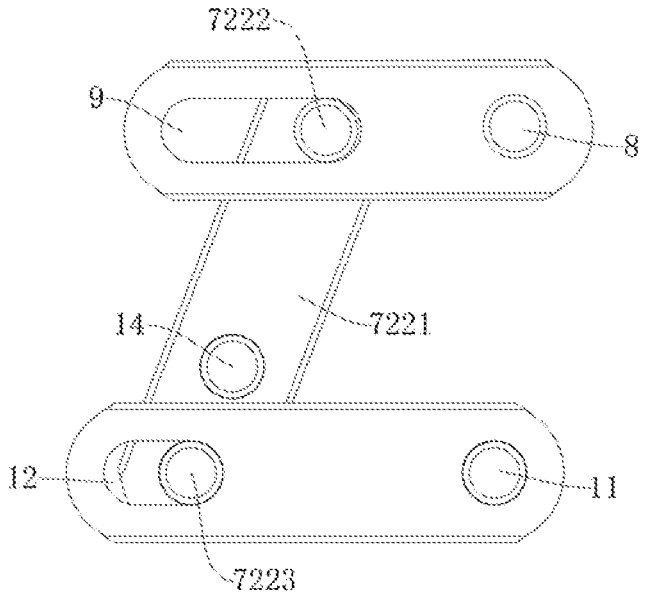
FIG. 5 is the schematic diagram of the using state of link mechanism.
Figure 6:
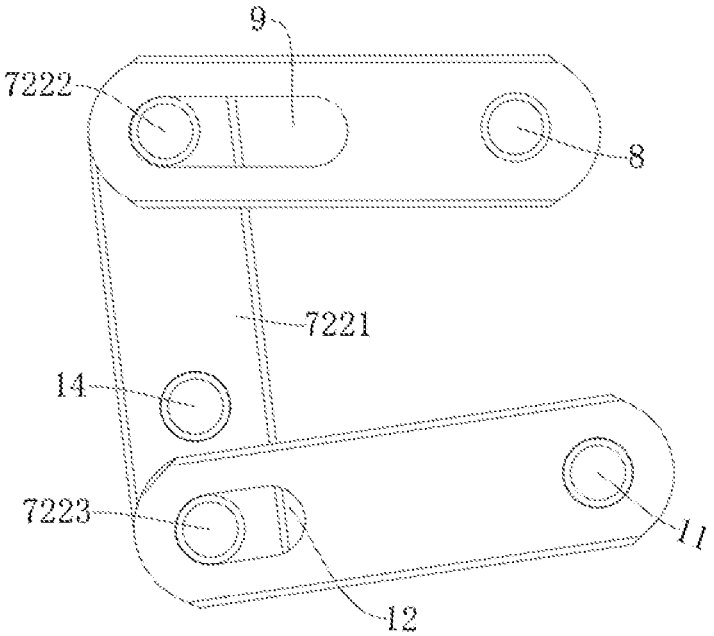
FIG. 6 is a reference diagram of another using state of link mechanism.

As shown in FIG. 5 and FIG. 6, FIG. 5 is the schematic diagram of the folding state of link mechanism, and FIG. 6 is a diagram of the opening state of link mechanism. When using, open the right handle 2 first and it will drive the first link rod 711 to move forward, while the second link rod will be driven to move backward, thus the U-shape seat will be driven to move forward. At first, the first concave boss 7222 stays at the end of the long chute 9, and when the second concave boss 7233 is slid to the front end of the short chute 12, the connecting rod 7221 interferes. Since the second concave boss 7233 is always pulled backward by the second link rod 721 the end of the connecting rod 7221 which is equipped with the second concave boss 7233 will move backward, while the other end of the connecting rod will move forward, thus making the first concave boss 7222 drive U-shaped seat 5 to move forward. Therefore, there will be 2 driving forces when U-shaped seat 5 moves, and the opening of right handle 2 is energy-saving. Finally, the first concave boss 7222 will be led to the front end of the long chute 9 by the connecting rods 7222.

Similarly, when riveting gecko peg, hold left handle 1 and right handle 2. Press right handle 2 tightly. Firstly, the right handle 2 will drive the first link rod to move backward and the second link rod to move forward, thus the U-shaped seat 5 will be driven to move backward. At first, the first concave boss 7222 stays at the end of the long chute 9, and when the second concave boss 7233 is slid to the front end of the short chute 12, the connecting rod 7221 interferes. Since the second concave boss 7233 is always pushed forward by the second link rod 721, the end of the connecting rod 7221 which is equipped with the second concave boss 7233 will move forward, while the other end of the connecting rod 7221 will move backward, thus making the first concave boss 7222 drive U-shaped seat 5 to move backward. Therefore, there will be 2 driving forces when U-shaped seat 5 moves, and the closing of right handle is energy-saving.

Of course, these are only preferred embodiment of the invention, and the patent scope of this invention shall not be confined by that. All applications using the instructions and drawings of the present invention with just simple modifications and equivalent structure changes shall be included in the scope of the patent protection of the present invention.

I claim:

1. A gecko riveter comprising a housing (100) having a top first end and a bottom second end, wherein the housing (100) comprises a first handle (1) and a second handle (2) on the second end; wherein the first end comprises a top part opposite to the two handles on the second end; wherein the first and second handles are respectively covered by a handle housing (3) and (4); wherein the housing (100) further comprises a U-shaped seat (5) at the top part; wherein the second handle (2) has a top end: wherein the top end of the second handle (2) is rotated relative to the top part of the housing (100) through a spindle (6); wherein the top end of the second handle (2) is installed with a link mechanism (7), wherein the link mechanism (7) is covered by the housing (100) and fixed to the housing (100) via screws; wherein the link mechanism (7) comprises a first linkage assembly (71) linked to the top end of the second handle (2) and a second linkage assembly (72) connected to the first linkage assembly (71); and wherein the second linkage assembly (72) is used to drive the U-shaped seat (5) to shift forward and backward.

2. The gecko riveter according to claim 1, wherein the first linkage assembly (71) comprises two paralleled first link rods (711) with the same shape and size eaching having two ends; wherein the second linkage assembly (72) comprises two second link rods (721) each having two ends; wherein one end of each second link rod (721) is fixed to the top end of the second handle (2) and below the first link rods (711)*z* and wherein the first link rods (711) and the second link rods (721) are connected via a connecting rod assembly (722) installed on the other end of each first link rod (711) and second link rod (721) on the same side.

3. The gecko riveter according to claim 2, wherein the two first link rods (711) are installed with a first pin (8) on the one end, and a long chute (9) on the other end; wherein the first pin (8) comprises upper and lower ends; wherein the top end of the second handle (2) is provided with a first pin hole (10) for the first pin (8) to be inserted by upper and lower ends; wherein the two second link rods (721) are installed with a second pin (11) on one end, and a short chute (12) on the other end; wherein the second pin (11) comprises upper and lower ends; wherein the top end of the second handle (2) is provided with a second pin hole (13) for the second pin (11) to be inserted by upper and lower ends;

wherein the connecting rod assembly (722) comprises two connecting rods (7221), a first concave boss (7222), and a second concave boss (7223); wherein the two connecting rods (7221) each comprise two ends; wherein the first concave boss (7222) and second concave boss (7223) are fixed to two ends of the connecting rods (7221); wherein the first concave boss (7222) goes through the long chute (9) and slide with the long chute (9); wherein the second concave boss (7223) goes through the short chute (12) and slide with the short chute (12); wherein each connecting rod (7221) is provided with a positioning axis (14) having a top end and a bottom end; and wherein the top and bottom ends of the positioning axis (14) are fixed to the top end of the housing (100).

4. The gecko riveter according to claim 3, wherein the distance between the positioning axis (14) and the first concave boss (7222) is longer than the distance between the positioning axis (14) and the second concave boss (7223).

5. The gecko riveter according to claim 3, wherein the U-shaped seat (5) comprises an inner end and an outer end; wherein the U-shaped seat (5) is provided with a punching hole (15) on the inner end; wherein the first concave boss (7222) comprises an upper end and a lower ends; wherein the upper and lower ends of the first concave boss (7222) are fixed via the punching hole (15); and wherein the U-shaped seat (5) is provided with a positioning slot (16) on the outer end.

6. The gecko riveter according to claim 5, wherein the top end of the housing (100) comprises an inner side and an outer side; and wherein the housing (100) is provided with a neck (17) on the outer side of the top end corresponding to the positioning slot (16).

7. The gecko riveter according to claim 5, wherein the top end of the second handle (2) is further provided with a third pin hole (18); wherein the first pin hole (10), third pin hole (18) and second pin hole (13) are set from top to bottom; wherein the spindle (6) comprises an upper end and a lower end; wherein the spindle (6) is set through the third pin hole (18); wherein the top part of the housing (100) is provided with a positioning hole (19) for the upper and lower ends of the spindle (6) to be locked into; wherein the spindle (6) is covered by a torsion spring (20); wherein the torsion spring (20) has two bifurcations (201), wherein one of the bifurcation (201) abuts against the second pin (11) and its (201) lower end locks into the first handle (1); and wherein the other bifurcation (201) abuts the connecting rod (7221), and its (201) lower end locks into the second handle (2).

8. The gecko riveter according to claim 7, wherein the distance between the first pin hole (10) and the third pin hole (18) is shorter than the distance between the second pin hole (13) and third pin hole (18).

9. The gecko riveter according to claim 7, wherein the top end of the first handle housing (3) is provided with a hook (21) having one hand, and one end of the hook (21) locks on the outer wall of the second handle (2).

10. The gecko riveter according to claim 1, wherein the top part of the housing (100) comprises an upper surface and a lower surface; wherein the housing (100) is provided with a long cover plate (22) and short cover plate (23) on the lower surface and the upper surface of the top part, respectively; wherein the long cover plate (22) has a cylinder (24) with threaded hole; wherein the housing (100) is provided with a through hole (25) on the top end for the cylinder (24) to go through; and wherein the cylinder (24) goes through the through hole (25) and then is fixed to the short cover plate (23) by a fastening screw (26).

* * * * *